United States Patent [19]

Nishikawa et al.

[11] Patent Number: 4,559,508

[45] Date of Patent: Dec. 17, 1985

[54] DISTRIBUTION CONSTANT FILTER WITH SUPPRESSION OF TE11 RESONANCE MODE

[75] Inventors: Toshio Nishikawa; Tadahiro Yorita, both of Nagaokakyo, Japan

[73] Assignee: Murata Manufacturing Co., Ltd., Japan

[21] Appl. No.: 578,199

[22] Filed: Feb. 8, 1984

[30] Foreign Application Priority Data

Feb. 10, 1983 [JP] Japan ..... 58-18909[U]

[51] Int. Cl.[4] ..... H01P 1/201; H01P 1/202

[52] U.S. Cl. ..... 333/202; 333/206; 333/222

[58] Field of Search ..... 333/202–212, 333/219, 222–235, 245, 248

[56] References Cited

U.S. PATENT DOCUMENTS 3,008,103 11/1961 Maurer et al. ..... 333/202
3,505,618 4/1970 McKee ..... 333/209 X
4,287,494 9/1981 Hashimoto et al. ..... 333/202
4,410,868 10/1983 Meguro et al. ..... 333/207 X

*Primary Examiner*—Marvin L. Nussbaum
*Attorney, Agent, or Firm*—Ostrolenk, Faber, Gerb & Soffen

[57] ABSTRACT

An improved distribution constant type filter provided with a connecting arrangement which includes a through-opening formed in a dielectric block of the filter along a first cavity of a resonance unit at an initial stage, and a connector provided in the through-opening so that one end of the connector is electrically conducted to a conductive layer formed on part of the outer surface of the dielectric block, with the other end of the connector being connected to an external circuit to receive an input signal. The through-opening is preferably small in lateral cross section relative to the first cavity and positioned at a central portion in a widthwise direction of the dielectric block, and thus, coupling magnetic between the resonance unit and the external circuit suppresses a TE11 resonance mode in the filter.

26 Claims, 13 Drawing Figures

DISTRIBUTION CONSTANT FILTER WITH SUPPRESSION OF TE11 RESONANCE MODE

BACKGROUND OF THE INVENTION

The present invention relates generally to an electrical filter and more particularly to a coupling construction of distribution constant type resonators employing a dielectric block for coupling thereof with external circuits in a distribution constant type filter working at a frequency range, for example, at 900 MHz or thereabout as in an application thereof to a radio communication equipment and the like.

Conventionally, for electrical filters to be applied to a frequency range in the order of several hundred MHz, the art has proposed filters which employ LC resonance circuits and coaxial resonators, etc. but most of these filters are unstable or complicated in structure, or their characteristics are not fully satisfactory, and require troublesome procedures for adjustments, without a possibility of reduction in cost.

Accordingly, there has also been conventionally proposed and put into practical application, an electrical filter which employs dielectric coaxial TEM resonators as the filter working at the frequency range of several hundred MHz.

As shown in an equivalent circuit diagram of a two-stage filter of FIG. 1, the known distribution constant type filter referred to above has a circuit construction including input and output terminals Is and Os, respectively, coupled, through input and output coupling electrostatic capacities Ci and Co, to $\frac{1}{4}$ wavelength resonance circuits Ri and Ro represented as concentrated constant circuits, thus constituting an electrical filter in which the $\frac{1}{4}$ wavelength resonance circuits Ri and Ro are coupled to each other through inductive coupling, while an external circuit and the $\frac{1}{4}$ wavelength resonance circuits are also coupled to each other through electrostatic capacitive coupling.

In one example of the specific construction as shown in FIGS. 2 and 3, the prior art distribution constant type filter generally includes a cubic box-like block B made, for example, of ceramic dielectric material of titanium oxide group, through-openings or cavities O1 and O2 formed in the dielectric material block B side by side, with a predetermined space therebetween, electrically conductive layers or inner conductors Eo1 and Eo2, respectively, formed on the inner peripheral faces of the through-openings O1 and O2, and another electrically conductive layer or outer conductor Es provided at least on four side faces of said dielectric material block B. The distribution constant type filter further includes another electrically conductive layer Eb provided on the bottom face of the block B for shortcircuiting one end of each of the inner conductors Eo1 and Eo2 and the outer conductor Es so as to produce $\frac{1}{4}$ wavelength resonance circuits thereby, an input coupling capacitor Ci connected to the other end of the inner conductor Eo1 and formed by providing confronting electrodes Ed1 and Ed2 on a cylindrical dielectric member d1. More specifically, to the other end of the inner conductor Eo1, a fixing member n1 made of an electrically conductive member such as a metallic cylindrical member or electrically conductive paste, is electrically and mechanically connected for securing, with the confronting electrode Ed2 being electrically and mechanically connected to the fixing member n1 for being fixed thereat. Meanwhile, there is also provided an output coupling capacitor Co connected to the other end of the inner conductor Eo2 and formed by providing confronting electrodes Ed3 and Ed4 on a cylindrical dielectric member d2. More specifically, to the other end of the inner conductor Eo2, another fixing member n2 made of electrically conductive member, for example, a metallic cylindrical member or electrically conductive paste in a similar manner as in the fixing member n1, is electrically and mechanically connected for securing, with the confronting electrode Ed4 being electrically and mechanically connected to the fixing member n2 for securing thereat. Thus, the resonance frequency is determined by electrical length of the inner conductor Eo1 or Eo2 shortened by the dielectric constant of the dielectric member B. The electrical length may be of $\frac{1}{4}$ wavelength or $\frac{1}{2}$ wavelength, and in the case of $\frac{1}{2}$ wavelength, the bottom conductive layer Eb is not required. It is to be noted that in the drawings, the thickness of the electrode layers and the electrodes, etc. are exaggerated with respect to the actual arrangement for better understanding. In the known arrangement as described so far, two resonance units are constituted, and there is further formed in the dielectric material block B, a cavity V having a cross section, for example, of a rectangular configuration, and the degree of inductive coupling between the two resonance units depends on the dimensions of said cavity V. The inner peripheral surface of the cavity V is not provided with any electrode layer. The cavity V need not necessarily extend through the dielectric material block B.

In FIGS. 4 and 5, there is shown another example of the specific construction of the prior art distribution type constant filter, in which the structure for the electrostatic coupling as described above with reference to FIGS. 2 and 3 is further simplified.

More specifically, in the filter of FIGS. 4 and 5, the input coupling capacitor Ci with the fixing member n1 and the output coupling capacitor Co with the fixing member n2 described as employed in the arrangement of FIGS. 2 and 3 are replaced by respective dielectric units U (FIG. 6) fitted under pressure into the through-openings 01 and 02 formed with the inner conductors Eo1 and Eo2 on the inner peripheral faces thereof as described earlier with reference to FIGS. 2 and 3.

Each of the dielectric units U is provided with a columnar or cylindrical portion U1 having, for example, a circular cross section and formed by applying a dielectric material of plastics or ceramics of titanium oxide group and the like, onto part of a conductive wire U2 having a diameter, for example, of 0.5 mm so that said conductive wire U2 axially extends therethrough, and has a taper portion U3 formed at its forward end for facilitation of insertion of said unit U into the through-openings O1 and O2 of the dielectric material block B, and also, a flange portion U4, for example, of a circular shape formed at its rear end so as to be brought into contact with a peripheral edge of each of the openings O1 and O2 of the block B where the outer conductor Es is not formed. As shown in FIG. 5, the dielectric units U are fitted, taper portions first, into the openings O1 and O2 of the block B formed with the inner conductors Eo1 and Eo2 until the flange portions U4 of the dielectric units U come into contact with the dielectric material block B.

By the known construction of FIGS. 4 through 6 as described above, the conductive wires U2 of the dielectric units U and the inner conductors Eo1 and Eo2 formed on the inner peripheral faces of the through-openings O1 and O2 of the dielectric material block B are electrostatically coupled to each other through the portions of the dielectric material of said dielectric units U, and thus, the input coupling capacitor Ci and output coupling capacitor Co described as employed in the conventional arrangement of FIGS. 2 and 3 may be dispensed with, and accordingly, troublesome procedures required for mounting such capacitors Ci and Co, etc. can be eliminated.

In the prior art arrangements of the electrostatic coupling system as described so far, there are cases where a TE11 mode resonance is produced as a spurious response as shown in FIG. 7. Although cut-off frequencies of TE11 mode are determined by a width "a" and a length "b" in FIG. 7, and particularly, when the arrangement is of a multi-stage construction, the length "b" in FIG. 7 is increased for lowering the resonance frequency of TE11 mode so as to approach the resonance frequency of TEM mode which is the mode employed.

Moreover, when the capacitors are employed for the electrostatic coupling between the resonance unit and the external circuit as in the known arrangement of FIGS. 2 and 3, not only are troublesome procedures required for mounting the capacitors to the dielectric material block B, with a consequent lowering of mass-productivity, but the overall size of the dielectric filter is undesirably increased.

Meanwhile, in the prior art arrangement in which the dielectric units U i.e. external circuit connecting pins are inserted into the through-openings O1 and O2 of the dielectric material block B, it is difficult to improve the structural accuracy, and if any air gap is produced between said through-openings and the dielectric units U, the coupling capacity becomes unstable resulting in the scattering of the characteristics at an initial stage. Furthermore, when the arrangement is subjected to temperature variations, the air gap is altered due to differences in coefficients of expansion, and the coupling capacity becomes unstable with time.

Similarly, in U.S. Pat. No. 3,505,618, there has also been conventionally disclosed a microwave filter which includes a dielectric material block coated with a conductive film on its outer surface to constitute a housing. The block is provided with holes and conductive members may be formed by depositing conductive film on the walls of the holes or they may be formed by a combination of the conductive film and rods which fit in the holes and contact with the conductive film. The filter characteristic may be made adjustable by threading the rods so as to be adjustably screwed in the holes. The prior art microwave filter as described above, however, also has disadvantages as described earlier with reference to the other known arrangements.

SUMMARY OF THE INVENTION

Accordingly, an essential object of the present invention is to provide an improved distribution constant type filter which is capable of suppressing generation of spurioius TE11 mode resonance.

Another object of the present invention is to provide a distribution constant type filter as described above in which uniformity and stability of the state of coupling for each product have been improved.

A further object of the present invention is to provide a distribution constant type filter as described above in which the coupling structure is simplified, and the parts employed are decreased in number so as to reduce the cost of construction.

In accomplishing these and other objects, according to one preferred embodiment of the present invention, there is provided a distribution constant type filter which includes a dielectric block member having an outer surface and at least one first cavity extending from said outer surface so as to form at least one first inner surface, connecting means for introducing an input signal into said block member and for producing an output signal therefrom, and conductive layers formed on at least part of said outer surface of said block member and at least part of said at least one first inner surface formed therein, thereby to constitute resonance unit means, wherein said dielectric block member has a plurality of first cavities spaced apart from one another to provide a plurality of first inner surfaces, said conductive layers extending into each of said plurality of first cavities, said block member having at least one second cavity extending from the outer surface thereof and positioned between two of said first cavities to provide at least one second inner surface, with said conductive layer not being formed on said at least one second inner surface. The connecting means includes a through-opening formed in said dielectric block member along said first cavity of the resonance unit means, and a connector member inserted in said through-opening so that one end of said connector member is electrically conducted to said conductive layer formed on at least part of said outer surface of said dielectric block member, with the other end of said connector member being connected to an external circuit means. The connecting means may be provided at an initial stage and/or a final stage. The through-opening is preferably small in cross section relative to said plurality of first cavities and positioned at a central portion in a widthwise direction of said dielectric block member, whereby magnetic coupling between the resonance unit means and the external circuit means suppresses a TE11 resonance made in the filter.

By the arrangement according to the present invention as described above, an improved distribution constant type filter has been advantageously presented through a simple construction.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
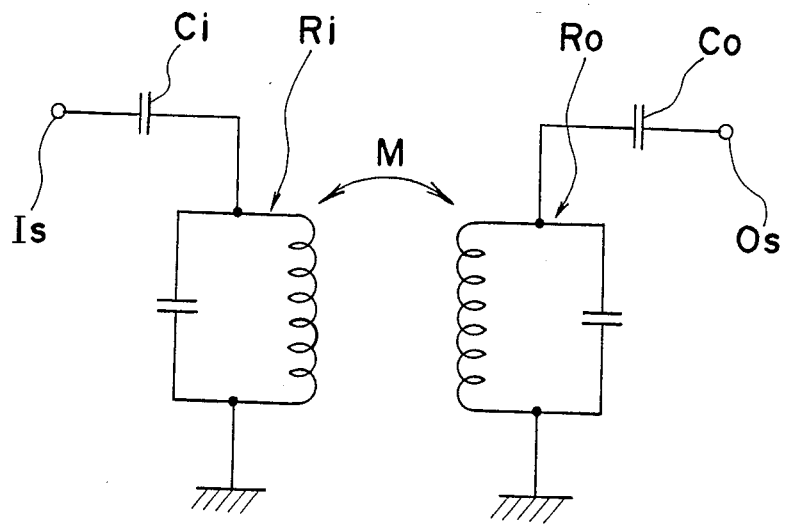
Fig. 1 PRIOR ART
FIG. 1 is an electrical circuit diagram showing a circuit construction of a conventional distribution constant type filter (already referred to)
Figure 2:
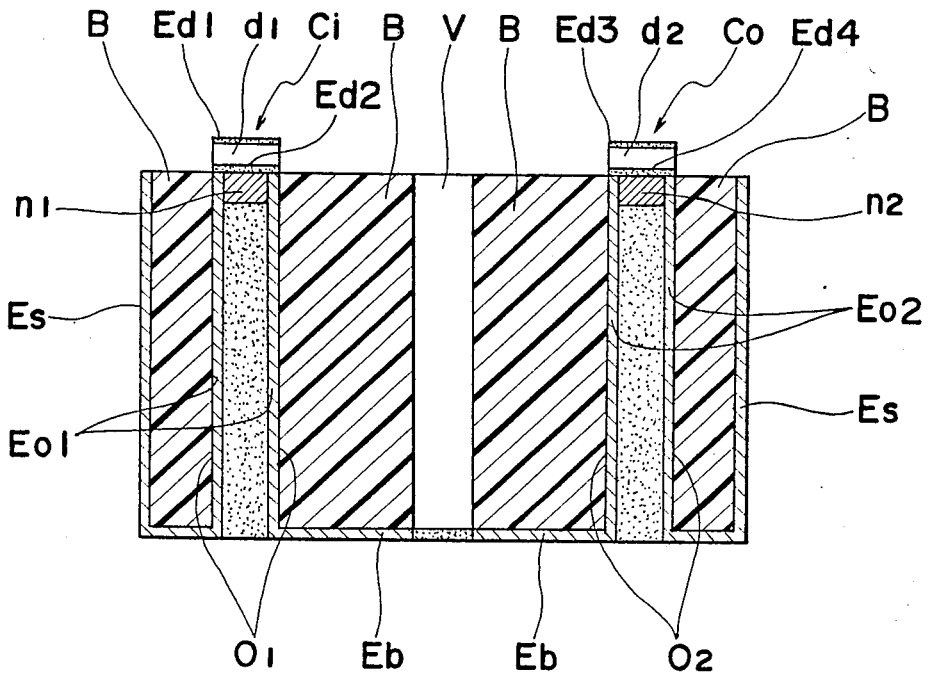
Fig. 2 PRIOR ART
FIG. 2 is a longitudinal sectional view showing one example of a conventional distribution constant type filter (already referred to)
Figure 3:
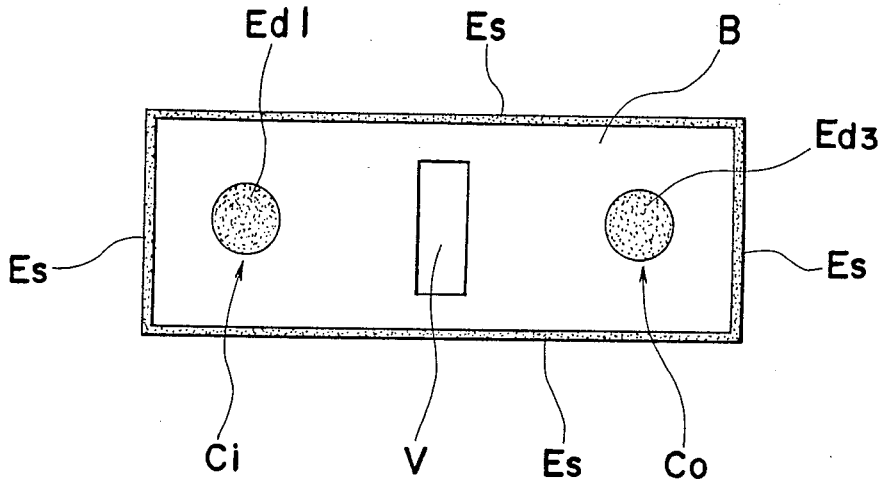
Fig. 3 PRIOR ART
FIG. 3 is a top plan view of the filter of FIG. 2.
Figure 4:
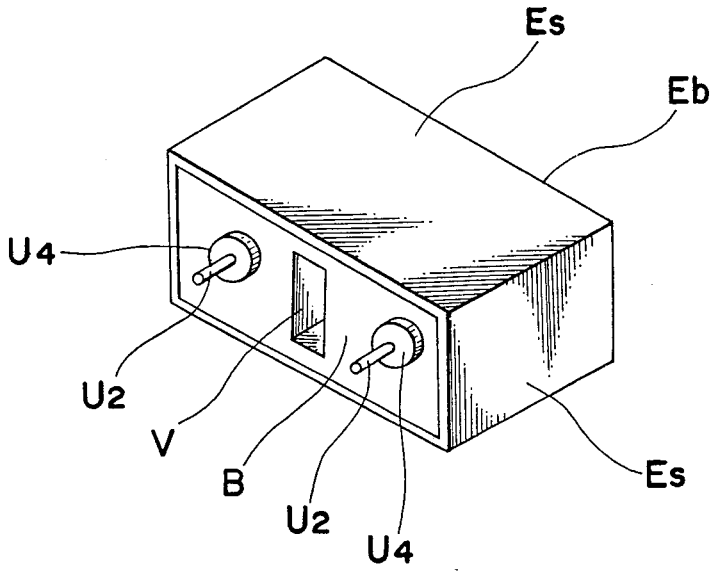
Fig. 4 PRIOR ART
FIG. 4 is a perspective view showing another example of a conventional distribution constant type filter.
Figure 5:
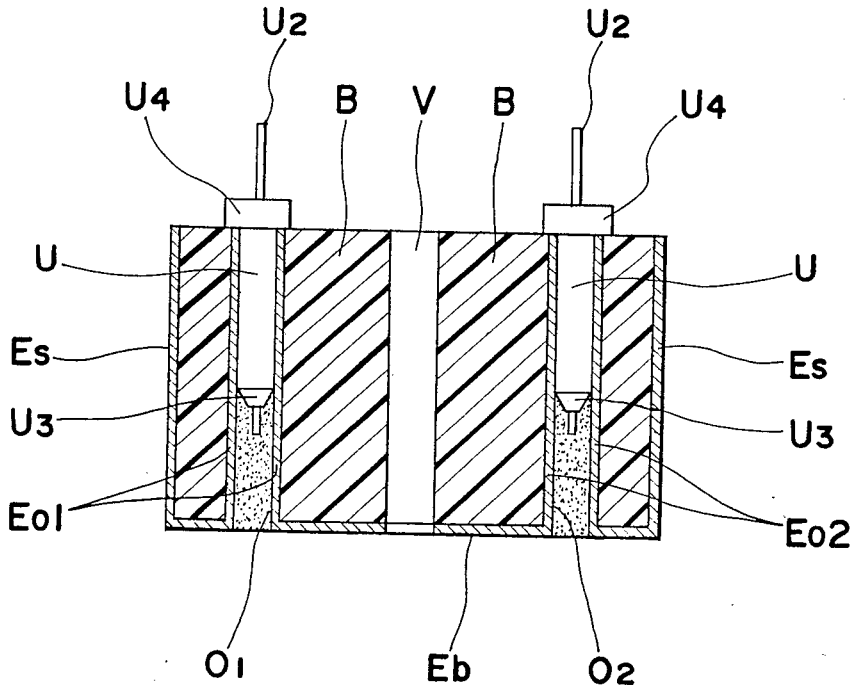
Fig. 5 PRIOR ART
FIG. 5 is a longitudinal sectional view of the filter of FIG. 4.
Figure 6:
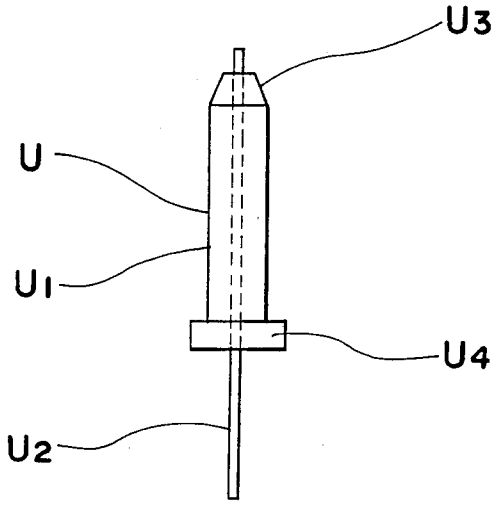
Fig. 6 PRIOR ART
FIG. 6 is a side elevational view showing on an enlarged scale, a dielectric unit employed in the filter of FIG. 4.

Before the description of the present invention proceeds, it is to be noted that like parts are designated by like reference numerals throughout the accompanying drawings.

Referring now to the drawings, there is shown in FIGS. 8 to 11, a distribution constant type filter according to one preferred embodiment of the present invention, which generally includes a rectangular cubic dielectric material block B made, for example, of a ceramic dielectric material of titanium oxide group and the like, bores or through-openings O1 and O2 formed in the dielectric material block B side by side at a predetermined spacing therebetween, inner electrically conductive layers or inner conductors Eo1 and Eo2, respectively, formed over the inner peripheral faces of said through-openings O1 and O2, an outer electrically conductive layer or outer conductor Es provided at least on four side faces of said dielectric material block B, another conductive layer Eb provided on the bottom face of the block B for shortcircuiting the inner conductors Eo1 and Eo2 to the outer conductor Es, and a cavity V formed at a central portion of said block B between the through-openings O1 and O2 in an axial direction thereof. The construction described so far is generally similar to that in the conventional arrangement described with reference to FIGS. 1 through 5 except for the particular constructions according to the present invention as described in detail below.

Figure 8:
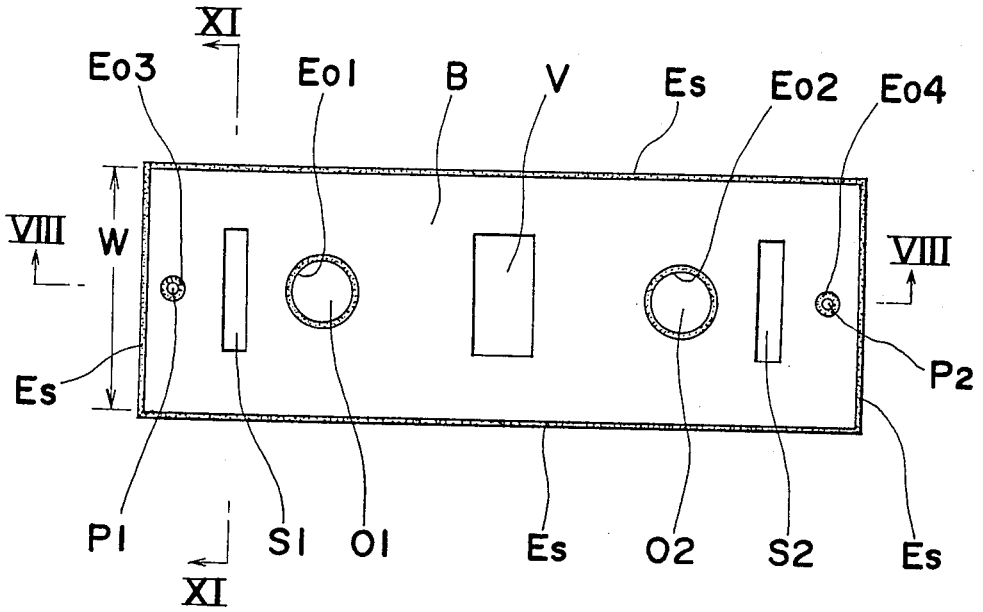
FIG. 8 is a top plan view of a distribution constant type filter according to one preferred embodiment of the present invention.
Figure 9:
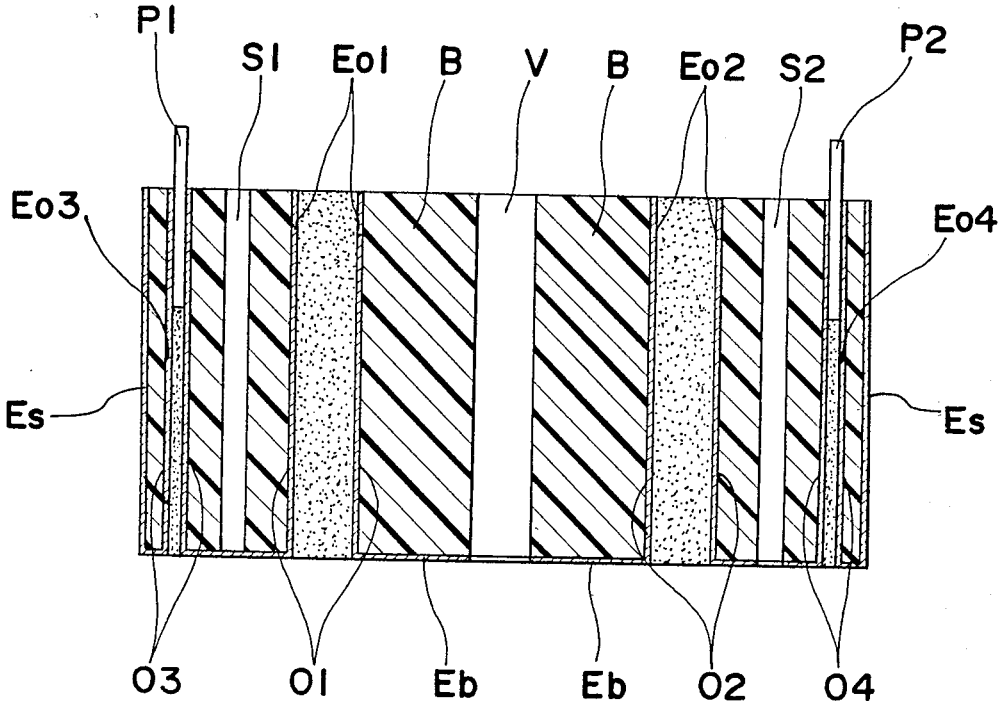
FIG. 9 is a cross section taken along the line VIII—VIII in FIG. 8.
Figure 11:
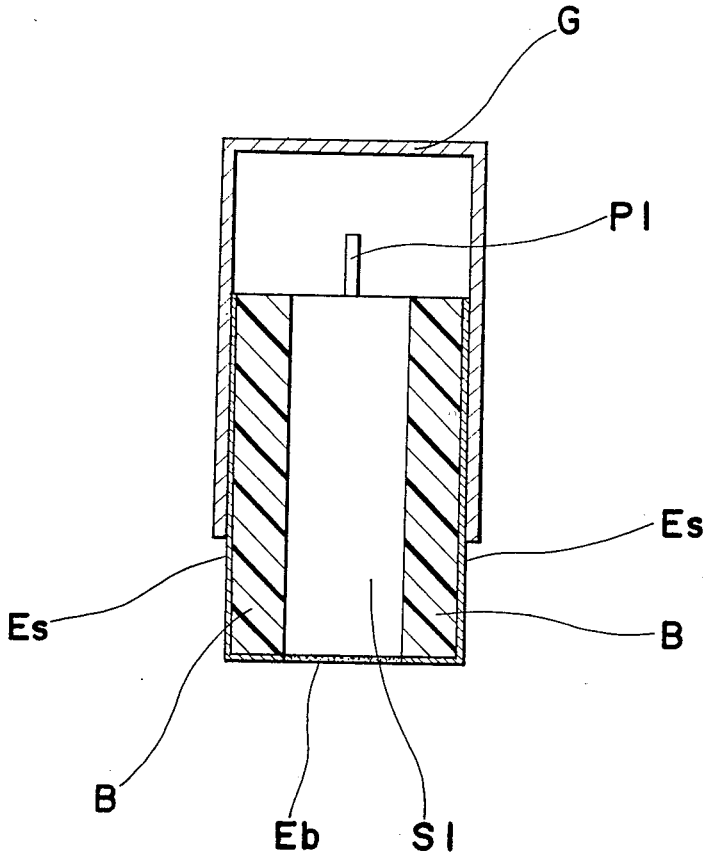
FIG. 11 is a cross section taken along the line XI—XI in FIG. 8.

More specifically, the distribution constant type filter of the present invention further includes, at its left-hand side in FIGS. 8 and 9, a small through-opening Q3 located at the central portion of a width W of the block B, i.e. at a position on the longitudinal section of the filter closer to the outer side face of the dielectric material block B and directed along the through-opening O1 of the resonance unit, an inner conductor Eo3 formed over the inner peripheral surface of the through-opening O3, with one end of the inner conductor Eo3 being connected to the conductive layer Eb at the bottom face of the block B, a metallic pin P1 for coupling inserted into the through-opening O3 and connected to the inner conductor Eo3 so as to be fixed thereat, and an induction coupling degree adjusting slit S1 having the structure and effect similar to those of the cavity V and provided between the openings O1 and O3 so as to extend through the block B. The pin P1 is connected to the external circuit directly or through a connector, or by the use of a coaxial cable (not shown). In a similar manner to that described so far, at the right-hand side in FIGS. 8 and 9, there are also provided a small through-opening O4, an inner conductor Eo4 formed over the inner peripheral surface of the through-opening O4, a metallic coupling pin P2 connected to the inner conductor Eo4 in the opening O4, and an induction coupling degree adjusting slit S2 formed between the openings O2 and O4. Furthermore, a grounding plate G is applied onto the filter to surround an open end upper surface thereof as shown in FIG. 11.

It should be noted here that the induction coupling degree adjusting slits S1 and S2 described as extended through the dielectric material block B may be replaced by similar slits formed in the block B, but not extended therethrough, or these slits S1 and S2 may be dispensed with as needed.

It should also be noted that the metallic coupling pins P1 and P2 may also be replaced by wires, central conductors of connectors or the like, and that the inner conductors Eo3 and Eo4 formed over the inner peripheral surfaces of the through-openings O3 and O4 are led out onto the bottom surface to be connected with the conductive layer Eb for the ground connection.

Another point to be noted is that, in the foregoing embodiment, although the present invention has been mainly described with reference to the distribution constant type filter having two stages, the arrangement of the present invention is not limited in its application to the filter of two stages alone, but may readily be applied to distribution constant type filters of three stages and more as needed, with more favorable effects being available as the number of stages is increased.

Figure 7:
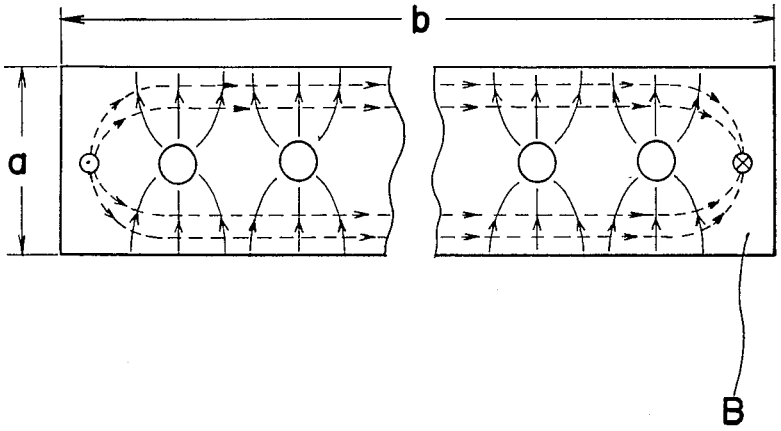
Fig. 7 PRIOR ART
FIG. 7 is a diagram showing the state of distribution of electro-magnetic fields in the conventional distribution constant type filters.
Figure 10:
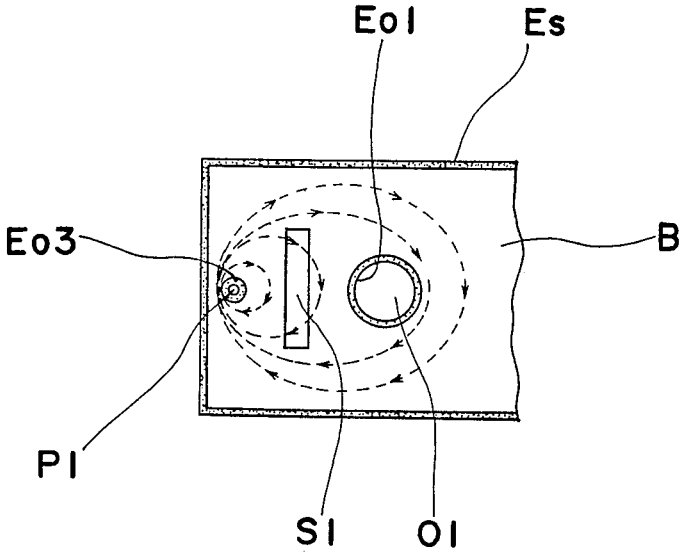
FIG. 10 is a fragmentary top plan view of the filter of FIG. 8 partly showing the state of distribution of electro-magnetic fields therein.

By the arrangement according to the present invention as described above, grounding current flows through the filter in a symmetric relation to produce the magnetic field coupling as shown in FIG. 10, in which the magnetic fields are directed in the opposite directions to each other at both sides of the inner conducting axis of the resonance units to be coupled to each other. In the TE11 mode, since the magnetic fields are to be directed in the same direction at both sides of the inner conductor axis as shown in FIG. 7, TE11 mode is not produced by the coupling structure according to the present invention. It is to be noted here that the degree of the input coupling may be determined by the distance between the through-holes O1 and O3 and the configuration and size of the slit S1, while the degree of the output coupling is determined by the distance between the through-openings O4 and O2 and the configuration and size of the slit S2. Although the cross section of the slit S may be, for example, in a circular, rectangular or elliptic shape, the rectangular configuration is most preferable, since designing of the filter is facilitated, while its size can be made compact.

Figure 12:
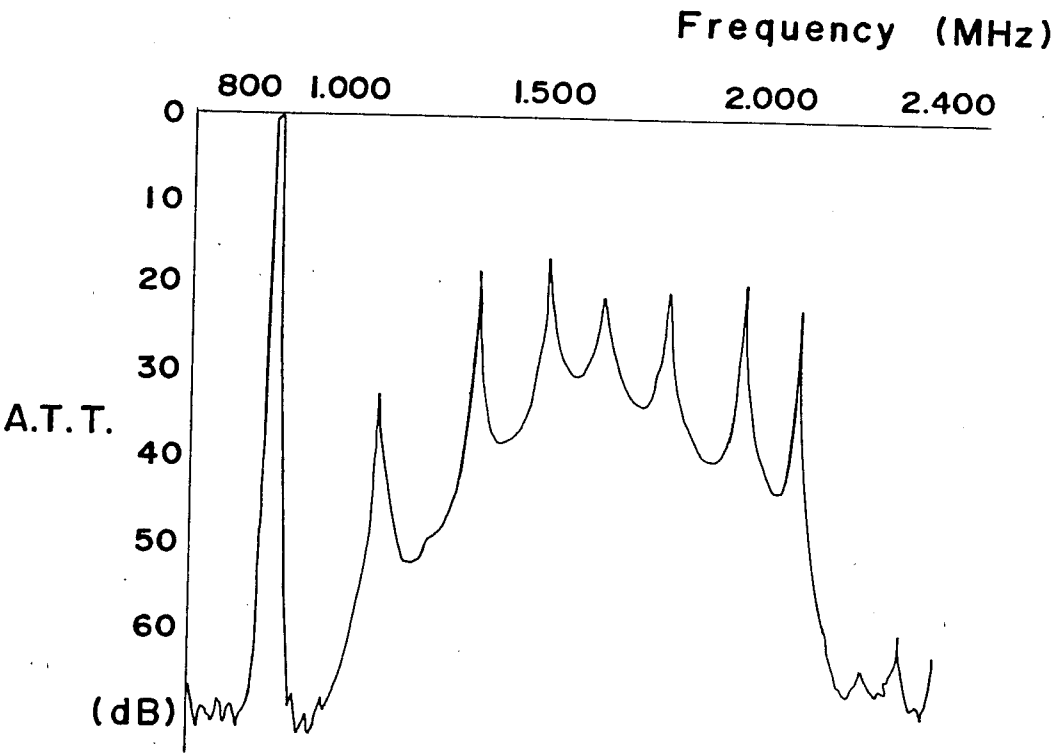
Fig. 12 PRIOR ART
FIG. 12 is a spurious characteristic diagram for the conventional distribution constant type filter of FIG. 2.
Figure 13:
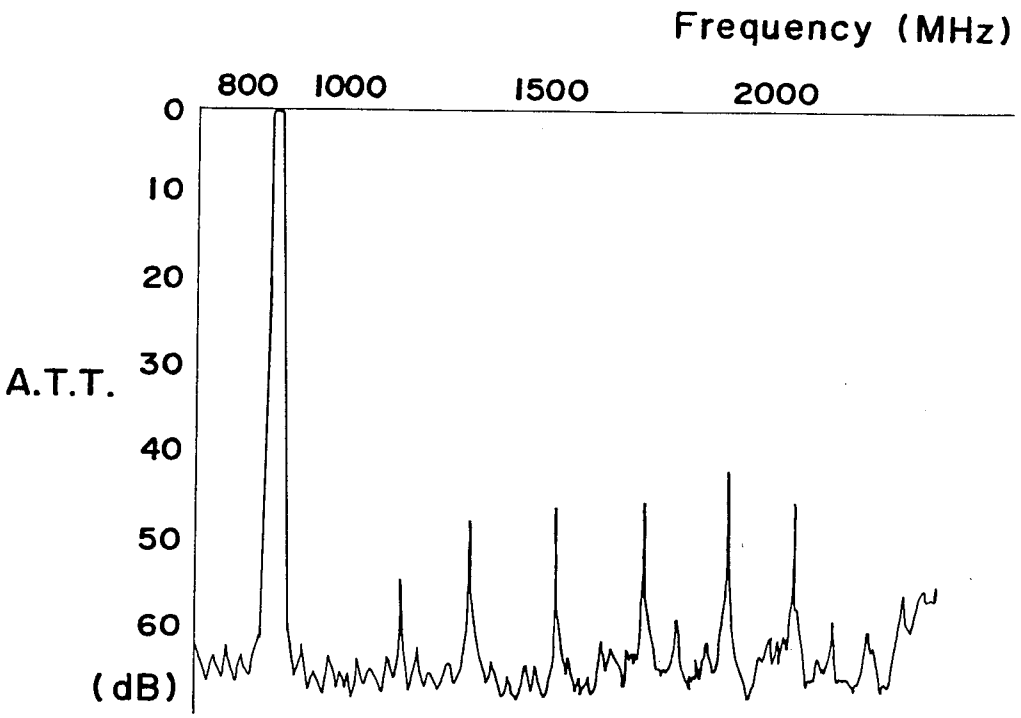
FIG. 13 is a spurious characteristic diagram according to one preferred embodiment of the present invention.

Upon comparison of a spurious characteristic diagram in FIG. 12 for the conventional filter with a spurious characteristic diagram of FIG. 13 for the filter according to the present invention, the improvement of the spurious characteristics can be seen in the filter of the present invention.

As is clear from the foregoing description, the spurious characteristics of the filter may be improved according to the present invention. Meanwhile, since the magnitude of the external coupling is to be determined by the distance between the coupling through-hole and the inner conductor of the resonance unit to be coupled, and the size and configuration of the external coupling adjusting slit, etc., once conditions are properly set, the filter may be thereafter manufactured by one piece molding through employment of metallic molds, with the dimensional accuracy at the portions as described above being stabilized, and the filter thus processed is in the best state ready for use when finished, without requiring any further corrections, etc. In other words, non-uniformity of the coupling state due to irregularities in the processing and manufacturing may be eliminated, and therefore, the state of coupling becomes uniform from product to product. Moreover, since the parts employed are only the external coupling conductors (i.e. the conductive layers or electrode layers formed in the external coupling through-holes and metallic pins provided as terminals as needed) and the dielectric ceramic material block, the arrangement is stable with respect to temperature, humidities and other circumstantial conditions, and no variations of the characteristics with time take place. Furthermore, for the external coupling, for example, the metallic pins are only inserted in the coupling through-holes so as to be connected and fixed thereat, the construction is simplified, with a consequent reduction in cost.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A distribution constant type filter, comprising:

(A) a resonance unit including:

(1) a dielectric block member having an outer surface, and having formed therein a pair of spaced apart first cavities extending from respective locations on said outer surface, each said first cavity forming a respective first inner surface;

(2) a conductive layer formed on at least part of said outer surface of said dielectric block member and extending into each of said first cavities and covering at least a portion of each of said first inner surfaces; and (B) connecting means for introducing an input signal into said resonance unit and withdrawing an output signal from said resonance unit, said connecting means including:

(1) an opening formed in said block member at a location adjacent to but spaced from one of said first cavities; and (2) a connector member located in said opening and electrically shorted to said conductive layer, said connector member extending outside of said opening so that it can be connected to an external circuit, the location and dimensions of said opening being such that magnetic coupling between said resonance unit and connecting means suppresses a TE11 resonance mode in said filter.

2. A distribution constant type filter as claimed in claim 1, wherein said dielectric block member has and induction coupling degree adjusting cavity formed therein at a location between said through-opening and said one of said first cavities.

3. A distribution constant type filter as claimed in claim 2, wherein said induction coupling degree adjusting cavity extends all the way through said dielectric block member.

4. A distribution constant type filter as claimed in claim 2, wherein said induction coupling degree adjusting cavity extends only partly through said dielectric block member.

5. A distribution constant type filter as claimed in claim 1, wherein said connector is a metallic wire.

6. A distribution constant type filter as claimed in claim 1, wherein said connector member is a metallic pin.

7. A distribution constant type filter as claimed in claim 1, wherein said connector member is a central conductor of a connector.

8. A distribution constant type filter as claimed in claim 1, wherein said connector member is electrically shorted to said conductive layer formed on at least part of said outer surface of said dielectric block member through another conductive layer forming on an inner peripheral surface of said opening.

9. A distribution constant type filter as claimed in claim 1, wherein said conductive layer is formed by a single conductive layer.

10. A distribution constant type filter as claimed in claim 1, wherein said block member has a width direction and wherein said opening is positioned at a location substantially at the middle of said block member as viewed along said widthwise direction.

11. A distribution constant type filter as claimed in claim 1, wherein said opening and connector member define an input connector to said resonance unit and wherein said connecting means further includes:

(A) a second opening formed in said block member at a location adjacent to but spaced apart from the other of said first cavities; and (B) a second connector member located in said second opening and electrically shorted to said conductive layer, said second connector member extending outside of said second opening so that it can be connected to said external circuit as an output connector, the location and dimensions of said second opening being such that magnetic coupling between said resonance unit and said output connector suppresses a TE11 resonance mode in the filter.

12. A distribution constant type filter as claimed in claim 11, wherein said block member has a width direction and wherein said second opening is positioned at a location substantially at the middle of said block member as viewed along said widthwise direction.

13. The distribution constant type filter as claimed in claim 11, wherein said second opening is small in lateral cross section relative to said pair of first cavities.

14. A distribution constant type filter as claimed in claim 1, wherein said opening has an axis which runs parallel to an axis of said one of said first cavities.

15. A distribution constant type filter as claimed in claim 1, wherein said connector member is connected to said external circuit.

16. The distribution constant type filter as claimed in claim 1, wherein said opening is small in lateral cross section relative to said pair of first cavities.

17. A distribution constant type filter which comprises a dielectric block member having an outer surface and at least one first cavity extending from said outer surface so as to form at least one first inner surface, connecting means for introducing an input signal into said block member and for producing an output signal therefrom, and conductive layers formed on at least part of said outer surface of said block member and at least part of said at least one first inner surface formed therein, thereby to constitute resonance unit means, wherein said dielectric block member has a plurality of first cavities spaced apart from one another to provide a plurality of first inner surfaces, said conductive layers extending into each of said plurality of first cavities, said dielectric block member being a substantially brick-shaped elongated element having first and second ends with an axis through the first and second ends and having first and second sides extending between the first and second ends, said plurality of first cavities being cylindrical cavities extending from said first side of said block member, the axes of said first cavities being substantially parallel to one another and substantially perpendicular to the axis of said block member, said conductive layers being of a metalized layer formed on at least part of each first cavity and the first side of the block member, said metalized layer being formed on substantially entirely the internal surface provided by each first cavity, and wherein said block member additionally has at least one second cavity positioned between two adjacent first cavities, said at least one second cavity having an axis substantially parallel to the axes of said plurality of first cavities, said connecting means including at least one through-opening formed in said dielectric block member along said first cavity of the resonance unit means at an initial and/or final stage, and a respective connector provided in each said through-opening so that one end of said connector is electrically shorted to said conductive layer formed on at least part of said outer surface of said dielectric block member, with the other end of said connector being connected to an external circuit means, said through-opening being small in lateral cross section relative to said pair of first cavities and positioned at substantially a central portion in a widthwise direction of said dielectric block member, whereby magnetic coupling between the resonance unit means and the external circuit means suppresses a TE11 resonance mode in the filter.

18. A distribution constant type filter as claimed in claim 17, wherein said conductive layer is formed by a single conductive layer.

19. A distribution constant type filter, comprising:

(A) a resonance unit including:

(1) a dielectric block member being elongated along an axis and having first and second ends located on opposite ends of said axis, said block member having formed therein:

(a) pair of spaced apart first cavities extending from respective locations on said outer surface of said dielectric block, each of said first cavities being elongated and having respective axes which are substantially perpendicular to said axis of said block member, each of said first cavities forming a respective first inner surface; and (b) a second cavity extending from said outer surface and located between said pair of first cavities, said second cavity forming a second inner surface, said second cavity being elongated and having an axis which lies substantially perpendicular to said axis of said block member; and (2) a conductive layer formed on at least part of said outer surface of said dielectric block member and extending into each of said first cavities and covering at least a portion of each of said first inner surfaces, said conductive layer not extending into said second cavity and said second inner surface not having any conductive material formed thereon; and (B) connecting means for introducing an input signal into said resonance unit and withdrawing an output signal from said resonance unit, said connecting means including:

(1) a first connector located adjacent said first end of said block member and between said first end of said block member and one of said first cavities, said first connector including:

(a) a first through-opening formed in said dielectric block member at a location adjacent to but spaced from one of said first cavities; and (b) a first connector member located in said first through-opening and electrically shorted to said conductive layer, said first connector member extending outside of said first through-opening so that it can be connected to an external circuit, the location and dimensions of said first through-opening being such that magnetic coupling between said first connector and said one of said first cavities suppresses a TE11 resonance mode in the filter; and (2) a second connector located adjacent said second end of said dielectric block member and between said other of said first cavities and said second end, said second connector including:

(a) a second through-opening formed in said block member at a location adjacent to but spaced from said other of said first cavities; and (b) a second connector member located in said second through-opening and electrically shorted to said conductive layer, said second connector member extending outside of said first through-opening so that it can be connected to an external circuit, the location and dimensions of said second through-opening being such that magnetic coupling between said second connector and said other of said second cavities suppresses a TE11 resonance mode in the filter.

20. A distribution constant type filter as claimed in claim 19, wherein said conductive layer is formed by a single conductive layer.

21. A distribution constant type filter as claimed in claim 19, wherein said block member has a width direction extending perpendicular to said axis and wherein said first and second through-openings are positioned at a location substantially at the middle of said block member as viewed along said widthwise direction.

22. A distribution constant type filter as claimed in claim 19, wherein said first and second through-openings have respective axes which run parallel to said axis of a respective one of said first cavities.

23. A distribution constant type filter as claimed in claim 19, wherein said block member is substantially brick-shaped.

24. A distribution constant type filter as claimed in claim 23, wherein said block member includes a top surface, a bottom surface, a front surface, a rear surface and left and right side surfaces, the plane of said left and right side surfaces defining said first and second ends, said axis of said dielectric block running parallel to said top, bottom, front and rear surfaces and running perpendicular to said left and right side surfaces.

25. A distribution constant type filter as claimed in claim 24, wherein said axes of each of said cavities and said axes of said through-openings run parallel to one another and perpendicular to said axis of said block member.

26. The distribution constant type filter as claimed in claim 19, wherein said first and second through-openings are small in lateral cross section relative to said pair of first cavities.

* * * * *